US009403264B2

(12) United States Patent
Hofmann et al.

(10) Patent No.: US 9,403,264 B2
(45) Date of Patent: Aug. 2, 2016

(54) REPLACEABLE DIE FOR PLIERS, PLIERS HAVING SUCH A DIE, AND STORAGE FIXTURE

(75) Inventors: Horst Hofmann, Unterschonau (DE); Thomas Wagner, Bermbach (DE); Georg Holland-Moritz, Rotterode (DE)

(73) Assignee: RENNSTEIG WERKZEUGE GMBH (DE)

( * ) Notice: Subject to any disclaimer, the term of this patent is extended or adjusted under 35 U.S.C. 154(b) by 1827 days.

(21) Appl. No.: 12/593,264

(22) PCT Filed: Mar. 18, 2008

(86) PCT No.: PCT/EP2008/053210

§ 371 (c)(1), (2), (4) Date: Sep. 25, 2009

(87) PCT Pub. No.: WO2008/116787

PCT Pub. Date: Oct. 2, 2008

(65) Prior Publication Data

US 2010/0101379 A1 Apr. 29, 2010

(30) Foreign Application Priority Data

Mar. 26, 2007 (DE) ..... 10 2007 014 903

(51) Int. Cl.

| | |
|---|---|
| ***B25B 7/02*** | (2006.01) |
| ***B25B 27/14*** | (2006.01) |
| ***B25B 7/04*** | (2006.01) |
| ***H01R 43/042*** | (2006.01) |

(52) U.S. Cl.

CPC ..... *B25B 27/146* (2013.01); *B25B 7/02* (2013.01); *B25B 7/04* (2013.01); *H01R 43/0424* (2013.01)

(58) Field of Classification Search

CPC ..... B25B 27/146; B25B 7/02; B25B 7/04; H01R 43/0424

USPC ..... 72/412, 413, 416, 409.01, 409.16, 72/481.1, 481.3, 481.6, 481.8, 72/482.1–482.3, 482.5, 482.91–482.93, 72/478–480; 81/421–432, 424.5, 486

See application file for complete search history.

(56) References Cited

U.S. PATENT DOCUMENTS

| | | | |
|---|---|---|---|
| 4,109,845 | A | 8/1978 | Wedge et al. |
| 5,884,540 | A | 3/1999 | Mo |

(Continued)

FOREIGN PATENT DOCUMENTS

| | | | |
|---|---|---|---|
| DE | 4343348 | A1 | 6/1995 |
| DE | 29810875 | U1 | 9/1998 |
| DE | 19802287 | C1 | 12/1998 |

(Continued)

*Primary Examiner* — Debra Sullivan

(74) *Attorney, Agent, or Firm* — Mark D. Wieczorek; Mayer & Williams PC

(57) ABSTRACT

The invention relates to a replaceable die for pliers to press workpieces, such as for crimping pliers for pressing electrical connector elements. By replacing the die, the pliers can be adapted to the press operation to be performed, such as adapting a crimping pliers to different types and sizes of the connector elements to be pressed. The die according to the invention comprises a first and a second die half that can be inserted into the pliers together and removed from the pliers together. The two die halves each have a guide for this purpose. Both die halves each further have a first connecting element for releasably attaching the die to the pliers. Both die halves finally each have a second connecting element for releasably attaching the die to a storage fixture. This ensures that the die formed by the two die halves is held in the storage fixture during or after removal from the pliers, and remains therein for storage.

18 Claims, 5 Drawing Sheets

(56) References Cited

U.S. PATENT DOCUMENTS

| | | | | |
|---|---|---|---|---|
| 6,053,025 | A * | 4/2000 | Beetz et al. | 72/409.16 |
| 6,769,173 | B2 * | 8/2004 | Chadbourne | 29/761 |
| 7,350,393 | B2 * | 4/2008 | Li | 72/409.16 |

FOREIGN PATENT DOCUMENTS

| | | | |
|---|---|---|---|
| DE | 20100031 | U1 | 5/2002 |
| DE | 202006010527 | U1 | 10/2006 |
| EP | 1353420 | B1 | 3/2005 |

* cited by examiner

REPLACEABLE DIE FOR PLIERS, PLIERS HAVING SUCH A DIE, AND STORAGE FIXTURE

FIELD OF THE INVENTION

The invention principally relates to replaceable dies for pliers for pressing of work pieces, for example for crimping pliers for pressing of electrical connector elements. Replacement of the die permits adaptation of the pliers to the press operation to be performed, especially adaptation to various types and sizes of the connector elements to be pressed. With this, for different crimping processes, it is not necessary to furnish different pliers, but instead only more dies for a single pliers. Additionally, the invention relates to pliers that can be equipped with such dies as well as a storage fixture in which such dies can be kept and with the aid of which simple replacement of the dies on one pliers is possible with no additional auxiliary media.

BACKGROUND OF THE INVENTION

From DE 298 10 875 U1 a pliers-like tool is known having replaceable jaws, in which each of the jaws is provided with a pin which can be inserted into corresponding recesses in the lever arms. What is disadvantageous about this solution is that, via the pins, not much force can be transmitted to the jaws.

EP 1 353 420 B1 discloses a crimping device that can be installed in a pliers or an automatic crimper. The crimping device comprises a carrier frame in which a crimping die and a crimping stamp are inserted. The crimping device can be replaced as an independent unit, so that it can be adapted to the contact element to be pressed.

U.S. Pat. No. 4,109,845 A discloses a pliers for attachment of pushbuttons, in which the receiver units for the pushbuttons can be replaced. The receiver units are each placed on one of the two jaws and secured with a screw. For replacement of these units, a tool is necessary, and quick replacement during frequently-changing work tasks is not practical.

DE 201 00 031 U1 discloses a pressing pliers with two clamping jaws that can be placed so as to swivel toward each other, on which corresponding pressing profile inserts are detachably held by a locking connection. The pressing profile inserts can be detached by overcoming the locking connection of the clamping jaws, and kept in the magazine guides in the handles of the pliers if they are not needed for a pressing operation. What is disadvantageous about this solution is that under certain circumstances, the individual pressing profile inserts must be individually loosened and attached. A further disadvantage is that only a small number of pressing profile inserts can be kept in the handles of the pliers, and that the profile inserts additionally stored in the handle cause an increase in the weight of the pliers. If multiple profile inserts are stored, additionally there is a danger that the user may select inserts that do not fit with each other and insert them into the pliers, which may lead to poor crimping results or even to the destruction of the profile inserts.

DE 198 02 287 C1 discloses a pressing pliers with at least one replaceable pressing jaw stored in a retaining jaw. The pressing pliers includes a drive for special shear-like movements of the retaining jaw. The replaceable pressing jaw has a flange placed in the periphery of the retaining jaw that has boreholes that are in alignment like the retaining jaw. Into the boreholes an attachment screw is inserted, with which the pressing jaw is detachably connected to the retaining jaw.

From DE 20 2006 010 527 U1, cable crimping pliers are known which first have a pliers body, in which a gripping pair and a head formed from two plates are connected by a joint. In the head is a structure of a clamping piece with two corresponding grasping surfaces. By means of two square, horizontal connection holes on both sides, the head offers a holder for the two ends of a square, inserted connecting piece. The connecting pieces each have available securing balls attached on the outer oppositely-placed sides that face away, and which correspond to the clamping piece. On its outer edge, the clamping piece has a relatively narrow connecting element which extends backward and thus forms the clamping element for an interior plug groove. Between the clamping element and the main body of the clamping piece, an insertion groove is configured through which the two inserted connecting pieces can be secured in the plug groove via the securing balls.

SUMMARY OF THE INVENTION

A main task of the present invention consists in making available a die that can easily and quickly be inserted into pliers, and also into a storage fixture.

A further part of the task of the invention consists in making available multiple dies in a storage fixture that are suitable for a multiplicity of different pressing tasks, in order, while using the storage fixture, to make possible easy die replacement on the pliers with no additional auxiliary media.

The named main problem is solved by a die according to the appended claim 1. The invention-specific die is provided for pliers for pressing of work pieces, and comprises a first and a second die half, between which the work piece to be pressed is inserted and obtains a desired shape from the pressing operation. The two die halves are jointly insertable into the pliers and jointly removable from the pliers. Thus, only a single operational step is required to insert the complete die into the pliers or to remove the same. For this, the two die halves have one guide. Additionally, the two die halves have a first connecting element for removable attachment of the die in the pliers. What is ensured is that after insertion into the pliers head, the two die halves are securely attached, even if during further operation the die is opened, and that thus it is possible to press the work pieces between the die halves found in the pliers. Lastly, the two die halves have a second connecting element for removable detachment of the die in a storage fixture. What this ensures is that, after removal from the pliers, the die formed by the two die halves can be held in the storage fixture and remains in same for storage. In this way, the die halves belonging to a die are always stored as a complete die, thus precluding a mixing of different die halves.

In a modified embodiment form, the two die halves can also be inserted individually into the pliers. But in this case two assembly steps are required; however, the flexibility of the pliers is increased, because different die halves can be combined with each other.

During the replacement process, the invention-specific die can be treated as one unit consisting of the two die halves, thus making possible uncomplicated handling using no tools during these procedures. The first and the second connecting elements optionally make possible a detachable securing in the pliers or in the storage fixture, so that it is possible to make a quicker and easier replacement.

The first connecting elements are preferably formed by open-jaw-like locking elements that are directed in an insertion direction. During insertion of the die into the pliers, the open-jaw-like locking elements can engage into corresponding connecting elements of the pliers, and can lock due to spring-loading or the like. Consequently, a force counter to the insertion direction may be used for removal of the die formed by the two die halves, by which the locking force is overcome and the open-jaw-like locking elements come out of the corresponding elements on the pliers. As an alternative, the first connecting elements may be so configured that they can lock into open-jaw-like locking elements of the pliers. However, the first connecting elements can also be formed by other detachable connecting media, such as, for example, spring-loaded locking balls, holding magnets, or latches.

The second connecting elements are preferably formed by hooks, which are placed on a side of the particular die half facing away from the insertion device. Consequently, the hooks are at or close to an outer side of the pliers when the die is inserted into the pliers. Thus it is possible to attach the storage fixture onto the die found in the pliers, so that the hooks are hooked into corresponding elements of the storage fixture, and also the open-jaw-like locking elements are locked into the corresponding elements of the pliers. Such an arrangement permits easy removal of the die from the pliers, which also serves for removal of the die from the pliers when it, for example, is to be stored when not used. Via the storage fixture, the force for unlocking the open-jaw-like locking elements can be transmitted to them. If the open-jaw-like locking elements are unlocked, the die can be removed from the pliers. It then is already held by the hooks in the storage fixture, so that no additional effort is necessary to bring the die into the storage fixture. But the second connecting elements can also be formed by other removable attachment media, such as closable latches, for example.

If an invention-specific die has been selected for pressing a certain work piece, and inserted into the pliers, then the first connecting elements preferably have entered into a removable connection with the first holding elements of the pliers. The first holding elements ensure that the two die halves are securely held in the pliers and it is possible to press the work piece to be pressed. Additionally, the first holding elements ensure that when the pliers are subsequently opened, the die halves detach from the pressed work piece and release it.

The invention-specific die is preferably so configured that the two die halves are placed at an interval from each other when the pliers are open, making it possible to insert the work piece to be pressed. When the pliers are closed, the two die halves adjoin each other, which means the die is closed, with the pressed work piece between the two die halves and the target shaping assumed. When the pliers are closed, the two die halves move toward each other in a closing direction. This closing direction preferably is perpendicular to the insertion direction. What is ensured by this is that the pieces of the pliers that act during closing of the pliers do not prevent insertion and removal of the die. Additionally to be avoided by this is that the removable connection of the first connecting elements in the insertion direction is not loaded by a force during closing of the piers, because such a force acts perpendicularly to the removal connection.

The first holding elements of the pliers are preferably formed by bolts that are enclosed by the open-jaw-like locking elements. The bolts ensure a secure attachment of the two die halves in the pliers. The locking elements and bolts make possible easy insertion of the die into the pliers. Such a locking connection is suited to frequent loosening and attaching. The elasticity necessary for the locking connection can be formed by a ball-shaped lock on the bolt. Alternatively, the open-jaw-like opening of the locking element can be configured to be elastic or as a spring-steel sheath.

In a modified embodiment form, the open-jaw-like locking elements are placed on the pliers while the bolts are placed on the die. Other removable connections between the pliers and the die are possible.

The die exclusively has open-jaw-like locking elements, and the hook preferably has a simple cuboid form, when the pliers are closed. Owing to this cuboid form, the die easily can be inserted into the pliers. Owing to the universal cuboid form, the die can be designed for the most varied pressing profiles. In addition the cuboid form allows equally distributed transmission of the forces necessary for the pressing operation from the pliers to the die. The open-jaw-like locking elements are placed on the outer side of the cuboid form, directed perpendicularly to the closing direction. Such an arrangement allows the pliers's head to be designed to be flat.

The open-jaw-like locking elements preferably have a rail at the transition to the cuboid form of the die, which forms the guide for insertion of the die formed by the two die halves into the pliers. This rail may be formed by a flat plate whose lateral surfaces ensure lateral guidance. Preferably such a plate has a smaller width than the cuboid form of the die, so that a step is formed which ensures guidance into the closing direction. In addition, the hooks are each configured as an angled-away expansion of one of the ends of the rail, so that the die obtains a compact form.

The two die halves, including the first and second connecting elements as well as the guide, preferably are embodied in one piece, and are preferably made of hardened tool steel. Such an embodiment allows the connecting elements to be manufactured at a low cost and to have a high load-bearing capacity.

If the invention-specific die is inserted into the storage fixture, preferably the second connecting elements with the two holding elements of the storage fixture are in a detachable connection. The two holding elements ensure that the two die halves are securely held in the storage fixture and cannot fall out. In addition, the two holding elements ensure that a force for inserting the die into the pliers or for loosening the die from the pliers can be transmitted from the storage fixture to the die. Thus, the storage fixture can function simultaneously as a grasping device for insertion and loosening of the die.

The second holding elements of the storage fixture are preferably formed by pivoting hooks that hook into the hooks of the two die halves. The pivoting hooks can be pivoted out by activation of a releasing element from the hooks of the die halves, so that the die no longer is held in the storage fixture. This embodiment form makes possible easy transfer of the die from the storage fixture into the pliers. After the die has been inserted into the pliers with the aid of the storage fixture, and has been locked there, the die is loosened from the storage fixture by activation of the release element, so that the storage fixture can be removed from the pliers.

Preferably the pivoting hooks are forced toward each other by a spring. They possess stop surfaces to be directed toward each other, between which a hollow wedge is formed that tapers down opposite to the direction of insertion. If a die is inserted into the storage fixture, first with its hook it impinges on the stop surfaces. In this area, the hooks have wedge surfaces directed away from each other, through which a wedge is formed that tapers down opposite to the direction of insertion. In regard to its dimensions, the wedge is adapted to the hollow wedge. If the die is inserted into the storage fixture, the wedge slides into the hollow wedge and pushes the pivoting hooks so that they pivot away from each other. If the wedge has been pushed until it is behind the hollow wedge, it then releases the swiveling hooks, whereupon they pivot into the hooks. This embodiment form makes possible quick and easy delivery of the die into the storage fixture. All that the die, still in the pliers, needs to do is to be inserted in the storage fixture, whereupon the pivoting hooks hook into the hooks of the die with no further manipulation, and thereby hold it. During this process, the pliers assume the function of a gripper for the die. Thus the die can be changed out between the pliers and the storage fixture, without being grasped directly by the hand. Other auxiliary media or tools are not needed.

One skilled in the art will recognize that the holding, locking and release functions between the storage fixture and the dies can also be implemented with other media. Suitable principles are sufficiently known that a detailed description is not needed here.

The storage fixture of the invention-specific die is embodied for example as a disk-shaped magazine, into which multiple dies can be inserted extensively. The disk-shaped magazine is especially well suited as a storage fixture, since it can accommodate a large number of dies, and also can be easily gripped, so that one of the dies can be inserted into the pliers without difficulties.

The storage fixture of the invention-specific die can alternatively be embodied as an individual magazine, with the individual magazine able to be detachably connected to one or more individual magazines, by which a multiple magazine with more dies can be formed. Such a magazine has the advantage that at little expense, the composition of the dies in the magazine can be altered.

The invention-specific die is especially suited to be a crimping die for pressing electrical attachment elements like terminal lead sheaths or contact plugs. The crimping die can have multiple hollow shapes for pressing various attachment elements. However, since there is a great number of differing attachment elements, the hollow forms insertable in a crimping die often do not suffice, so that additional crimping dies with additional hollow forms are needed. According to the invention, they can be quickly and easily changed between the pliers and the storage fixture.

The invention-specific die can also be designed for other types of work pieces to be pressed. For example, the die can be designed for pressing of mechanical connecting elements like pushbuttons, or for pressing of mechanical locking elements. The die can also be designed for stamping of designations and markings.

Since it must be ensured, when a die is removed from the pliers, that no greater clamping forces are acting between die and pliers than those arising when the pliers is totally closed, it is advantageous if the pliers can be brought into a defined die-changing position. For example, this is successfully done by pivoting a locking hook between the hand grips of the pliers which maintains a minimum distance between the grips.

Additionally, it can be advantageous if a locking element is attached to the die itself, with which the two die halves can be locked toward each other in a closed position, so that the die also can stay closed when it is removed from the pliers and not inserted into a storage fixture. Preferably the locking element is so designed that it automatically releases the die halves when the die is inserted into the pliers.

Additional examples, particulars and further embodiments of the present invention can be gleaned from the following description of multiple preferred embodiment forms, with reference to the drawings.

DETAILED DESCRIPTION

Figure 1:
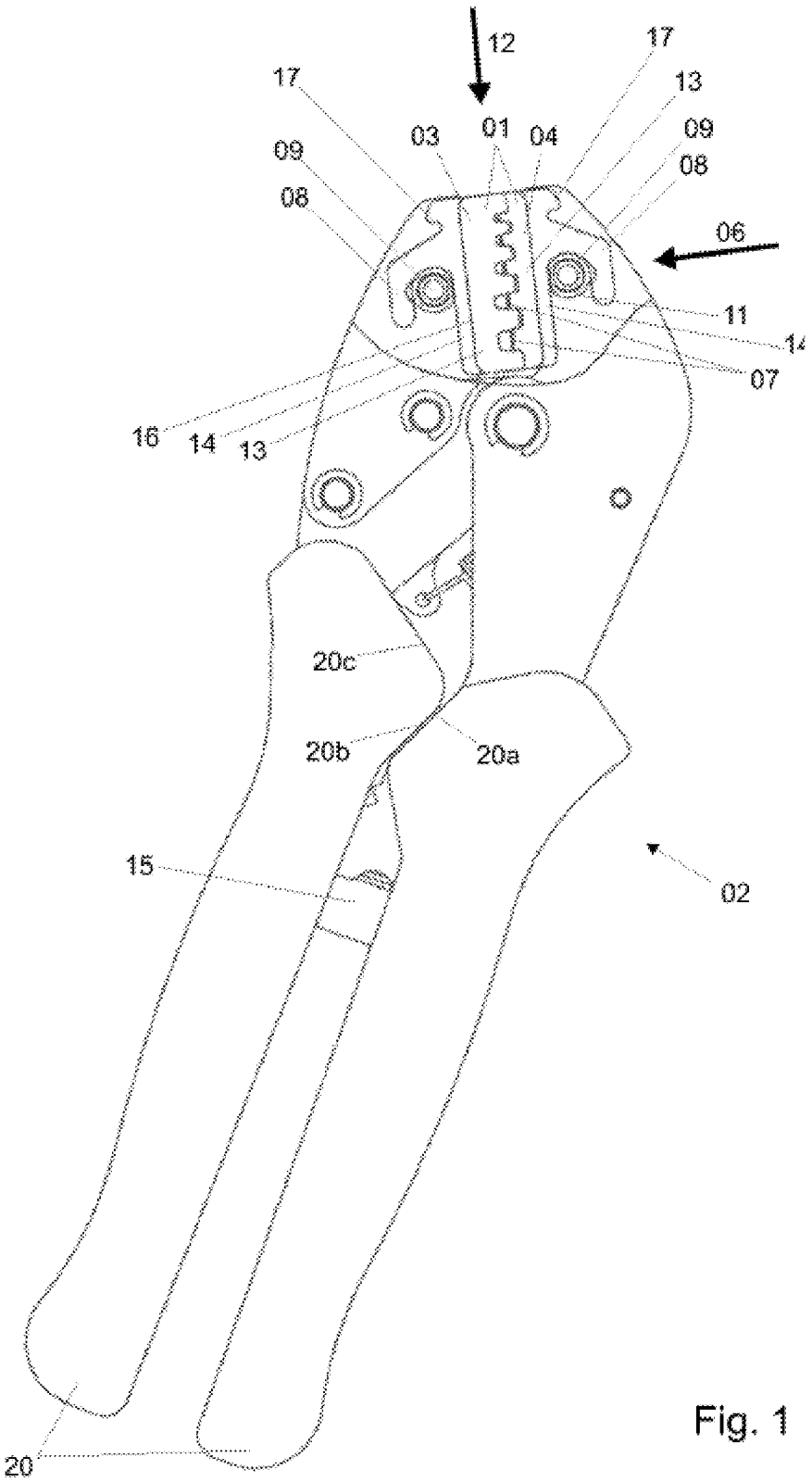
FIG. 1 illustrates an invention-specific crimping die in a set of closed crimping pliers.
Figure 2:
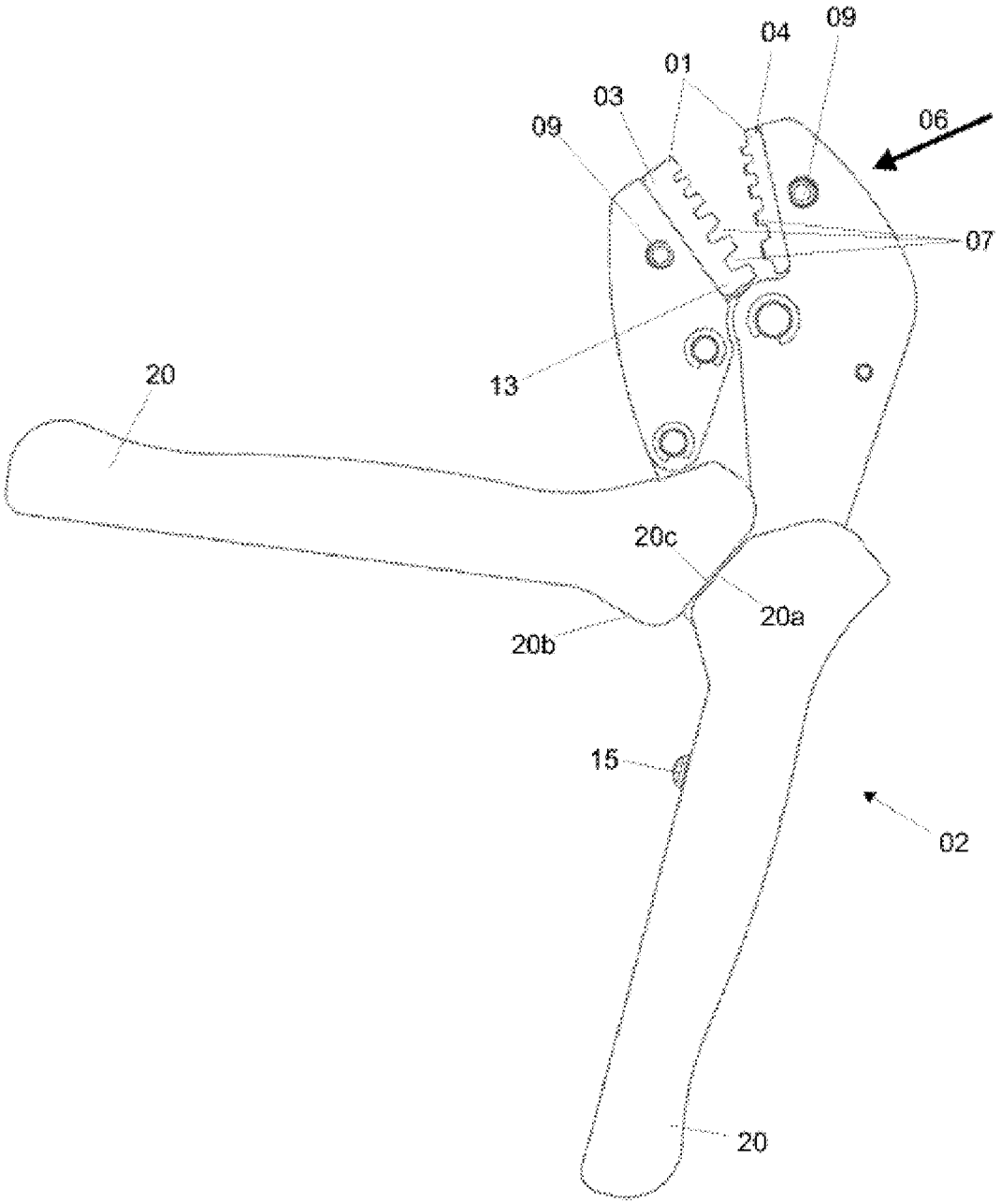
FIG. 2 illustrates the crimping die showed in FIG. 1 with the crimping pliers opened.

FIG. 1 shows an invention-specific crimping die 01, which is inserted into crimping pliers 02. The crimping die 01 comprises a first die half 03 and a second die half 04 that are only indirectly connected with each other via the crimping pliers 02. The crimping pliers are shown in a closed condition, in which the two die halves 03, 04 are situated to adjoin one another. If the crimping pliers 02 are opened, the two die halves 03, 04 are at a distance from one another as FIG. 2 shows. When crimping pliers 02 are closing, the two die halves 03, 04 move toward each other in a closing direction 06. The sides of the die halves 03, 04 to be directed toward each other have multiple hollow forms 07 for crimping of electrical attachment elements of various sizes. For crimping of an electrical connection element, it is inserted into the hollow form 07 provided for this into the first or second die half 03, 04, when the crimping pliers 02 are open. Then crimping pliers 02 are closed, so that the inserted electrical attachment element undergoes a re-shaping within the closing hollow form 07 as a result of the pressing operation. For example, by this means, a terminal lead sheath can be attached to a conductor by pressing.

In the area of crimping die 01, crimping pliers 02 are shown as partially cut away, so that crimping die 01 is fully visible. Each of the two die halves 03, 04 has an open-jaw-like locking element 08 which is placed on bolts 09 on the jaws of crimping pliers 02, so that between the open-jaw-like locking elements 08 and the bolts 09 a detachable locking connection is produced. For this, the bolts 09 have a spring sheath 11 or ball lock, that is locked into the particular open-jaw-like locking element 08 by overcoming its spring force. Die 01 is detachably connected via the two locking connections with crimping pliers 02. The die 01 is inserted into crimping pliers 02 by insertion of same into an appropriate receptacle which is found on the particular jaw of crimping pliers 02, in an insertion direction 12. The openings of the open-jaw-like locking elements 08 are directed in the insertion direction 12, so that when inserted, they admit the bolts 09 and lock on the same.

The hollow forms 07 are each arrayed on a cuboid-shaped center piece 13 of die halves 03, 04. The open-jaw-like locking elements 08 are all connected via a flat rail 14 with the cuboid-shaped center piece 13 of the particular die halves 03, 04. The flat rail 14 extends over the entire length of crimping die 01, but has a smaller width than center piece 13 of the two die halves 03, 04. By this means, between rail 14 and cuboid-shaped center piece 13, a step 16 is formed, which forms a guide for insertion of crimping die 01 into crimping pliers 02. The lateral surfaces of open-jaw-like locking element 08 make possible lateral guidance during insertion of crimping die 01 into crimping pliers 02. Guidance can also be attained by other structural measures such as a through-running opening, into which one or more pins of the pliers engage. Insertion direction 12 is perpendicular to closing direction 06, so that the configuration of die 01 as regards the crimping function is for the most part independent of its configuration as regards the insertion function. By this means, for example, it is ensured that the locking connection is not broken by pressing force when the pliers are being closed.

At their ends, the flat rails 14 are angled off so that a hook 17 is formed. The hooks 17 are located at the end of rail 14 facing outwards, which is directed away from insertion direction 12. Thus, they are located at the periphery of crimping pliers 02. Vis-à-vis crimping pliers 02, the hooks 17 have no function.

In the position shown in FIG. 1, the pliers 02 are in a position that permits die 01 to be admitted. For this, a locking hook 15 between the two hand grips 20 of the pliers is pivoted out, which maintains the minimum distance between them. The minimum distance is chosen so that die 01 is loosely closed, but still no clamping forces appear that block removal of the die. With this, in the normal operating state, the pliers can be completely closed, with locking hook 15 pivoting into a hand grip 20 (FIG. 2).

One further special feature of the crimping pliers is in the shaping of the hand grips 20 at their ends that face toward the pliers head. The sheathing of the hand grips, which may for example, consist of plastic, is configured in this end area into complementary-shaped locking surfaces 20*a*, 20*b* and 20*c* at the ends of the hand grips that face each other. Locking surface 20*a* on the hand grip to be regarded as fixed, in the closed state of the pliers (FIG. 1), lies parallel opposite a rear locking surface 20*b* on the hand grip to be regarded as movable in such a way that in essence no gap remains. In the opened state, locking surface 20*a* in turn lies parallel opposite a front locking surface 20*c* of the movable hand grip, so that no greater gap remains between the locking surfaces. Locking surfaces 20*b* and 20*c* on the movable hand grip are roughly perpendicular to each other and are linked by a rounded section, which pivots past opposite locking surface 20*a* when the pliers are opened or closed. This embodiment shape of the ends of the hand grips ensures that the user's fingers cannot slip between the end areas of the hand grips that face the pliers head, thus avoiding the danger of a pinching.

FIG. 2 shows crimping pliers 02 with inserted die 01 in an opened state. The two die halves 03, 04 are at a distance from each other. Especially the hollow forms 07 are visible, which are all configured into one piece in the first die half 03 and into another piece in the second die half 04. In the state of the opened crimping pliers 02 shown, the electrical attachment element to be pressed can be inserted in the particular hollow form 07 between first die half 03 and second die half 04.

Figure 3:
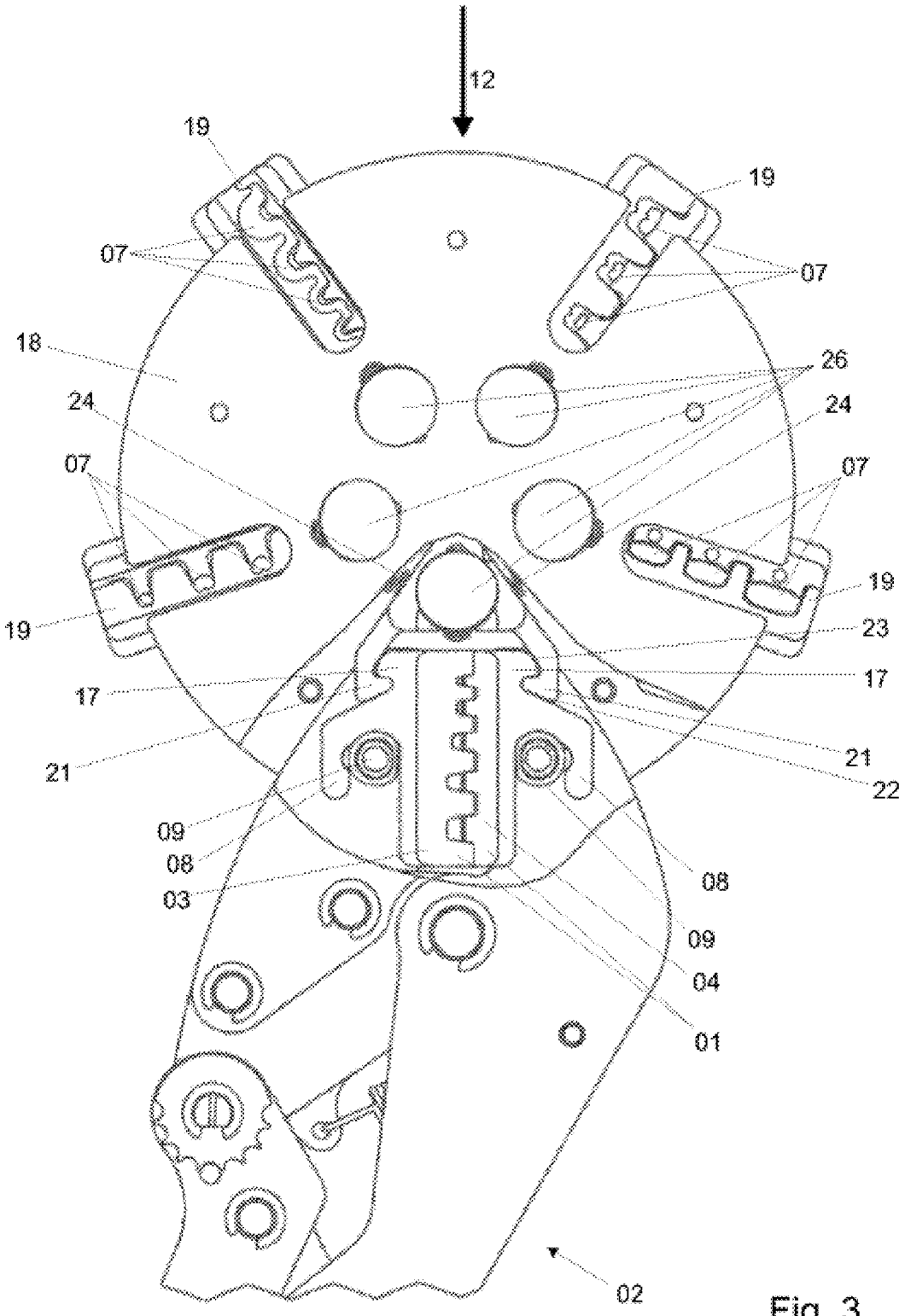
FIG. 3 illustrates the crimping die shown in FIG. 1 during transfer from the crimping pliers into a magazine.

FIG. 3 shows the invention-specific crimping die 01, which is found simultaneously in crimping pliers 02 and in a disk-shaped magazine 18. For example, such a condition is present if the crimping pliers 02 would be inserted into magazine 18 to replace crimping die 01. Crimping die 01 permits quick and easy replacement of the same. It can be directly inserted from magazine 18 into crimping tool 02. In just the same way, crimping die 01 can be inserted directly from crimping pliers 02 into magazine 18 for storage. Now another invention-specific crimping die 19, which is stored in magazine 18, can be inserted into crimping pliers 02. The other crimping die 19 differs from the original crimping die 01 in that it has other hollow forms 07. The invention-specific crimping die 19 kept in the magazine has a multiplicity of hollow forms 07, so that a multiplicity of hollow forms 07 are available. Thus, with the aid of the magazine and of the invention-specific crimping dies 01, 19 found in it, crimping pliers 02 can quickly and easily be adapted to many different kinds of electrical connector elements to be pressed.

In FIG. 3, magazine 18 and crimping pliers 02 are shown in a partially cut-away view in the area of the insertion of crimping pliers 02 into the magazine, so that crimping die 01 is fully visible. Additionally, the pivoting hooks 21 of magazine 18 are shown, which hold crimping die 01 in magazine 18. The pivoting hooks 21 are hooked into the hooks 17 of the two die halves 03, 04, after crimping die 01, which is found in crimping pliers 02 with no changes, has been inserted into magazine 18. For this, the area of crimping pliers 02, in which crimping die 01 is found, has been inserted into magazine 18, for which crimping pliers 02 and magazine 18 are grasped by the user. Crimping die 01 is not to be grasped for this. Crimping pliers 02 are to be inserted in a free area of magazine 18, in which there is no crimping die. The area between the pivoting levers 21 is still free at the time prior to the insertion of crimping pliers 02 with crimping die 01.

During insertion of crimping pliers 02 with crimping die 01, first the hooks 17 strike against pivoting hooks 21. In this area, pivoting hooks 21 have stop surfaces 22 to be directed toward each other, between which a hollow wedge is formed that tapers opposite to the insertion direction 12. In this area, the hooks 17 have wedge surfaces 23 directed away from each other, through which a wedge is formed that tapers down opposite the insertion direction 12. When the crimping pliers 02 with crimping die 01 are inserted, wedge surfaces 23 push pivoting hooks 21 away from each other, so that they pivot away from each other and make possible entry of the hooks 17 into the area between the two pivoting hooks 21. The two pivoting hooks 21 are forced toward each other by a compression spring 24.

After the hooks 17 have been fully slid into the area between the two pivoting hooks 21, the two pivoting hooks 21 pivot back toward each other again due to the spring forces applied by compression springs 24, and hook into hooks 17. From this point onward, crimping die 01 is held in magazine 18. If now a force is exerted on crimping pliers 02 against magazine 18, which is directed opposite the insertion direction 12, crimping die 01 cannot again be withdrawn from magazine 18, since the two pivoting hooks 21 hold crimping die 01 on its hooks 17. Therefore, starting at a certain force, the two locking connections get loose between the open-jaw-like locking elements 08 and the bolts 09, so that the crimping die glides out of crimping pliers 02. Crimping pliers 02 are then separated from magazine 18 and do not contain a crimping die.

Now another crimping die 19 can be selected and crimping pliers 02 can be inserted into magazine 18 at the position of this crimping die 18, so that in turn crimping die 19 is inserted into crimping pliers 02. When this is done, the open-jaw-like locking elements 08 of crimping die 19 lock into the bolts 09. By pressing a release button 26, the two assigned pivoting hooks 21 are pivoted away from each other, and release the hooks 17 of crimping die 19. Now crimping pliers 02, along with crimping die 19, can be withdrawn from magazine 18, with both of the locking connections between open-jaw-like locking elements 08 of crimping die 19 and the bolts 09 of crimping pliers 02 being in engagement. Thereupon, crimping pliers 02 with the other crimping die 19, is available for pressing the electrical connector elements suited to the other crimping die 19.

Figure 4:
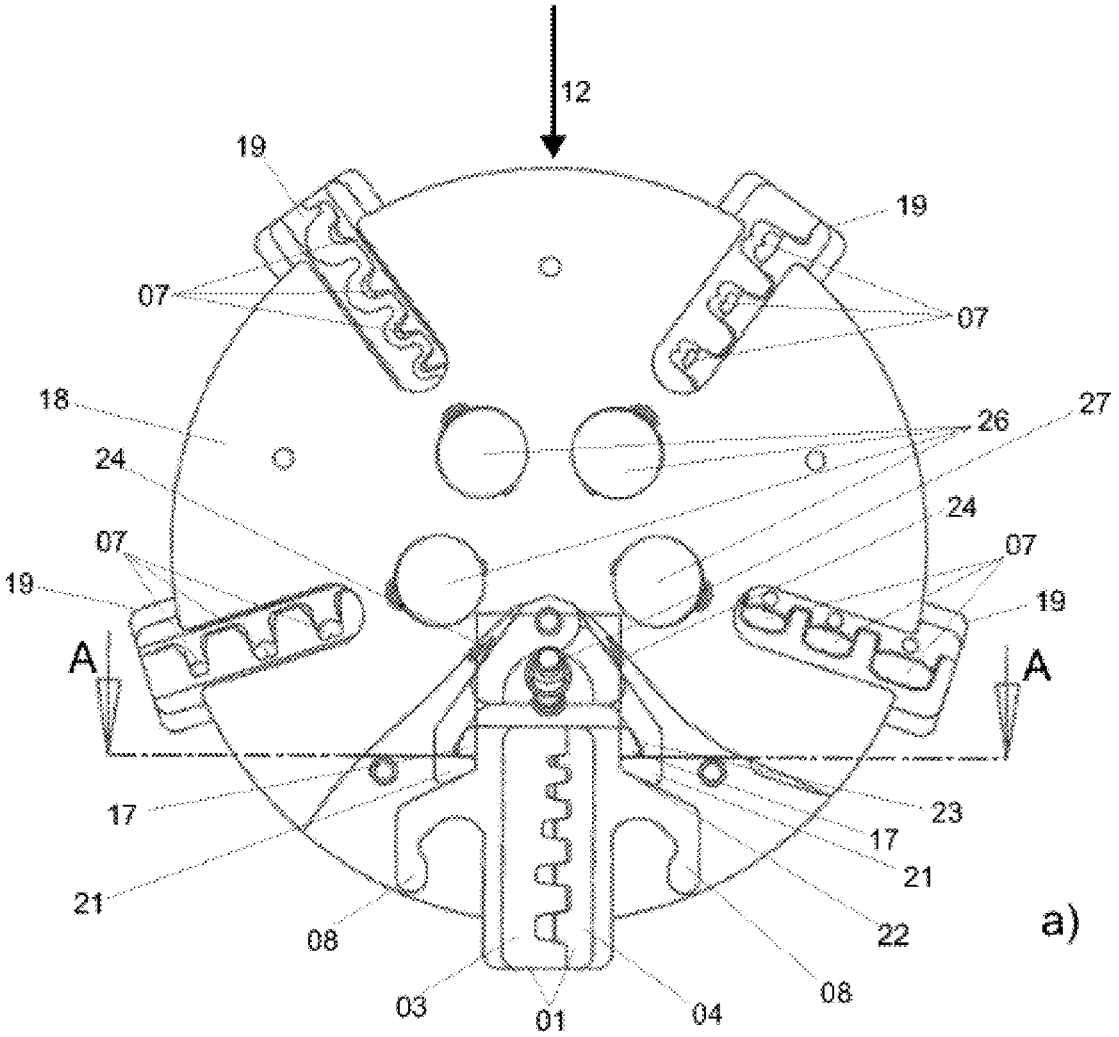
FIG. 4 illustrates two views of the crimping die shown in FIG. 1 in the magazine.
Figure 4:
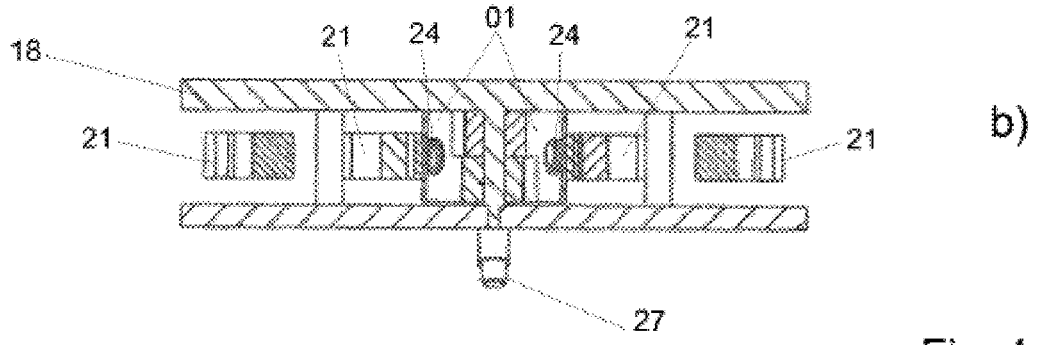

FIG. 4 shows crimping die 01 when it is located in magazine 18 after crimping pliers 02 have been removed. Depiction a) of FIG. 4 shows a top-down view which is partially cut away. Depiction b) of FIG. 4 is a cross-sectional depiction of section A-A as marked in depiction a). In the cross-sectional views, one of the release buttons 26 is not shown, so that a release pin 27 beneath it is visible. By pushing release button 26, the release pin 27 found beneath is simultaneously pushed, which pivots the two assigned pivoting hooks 21 away from each other.

Figure 5:
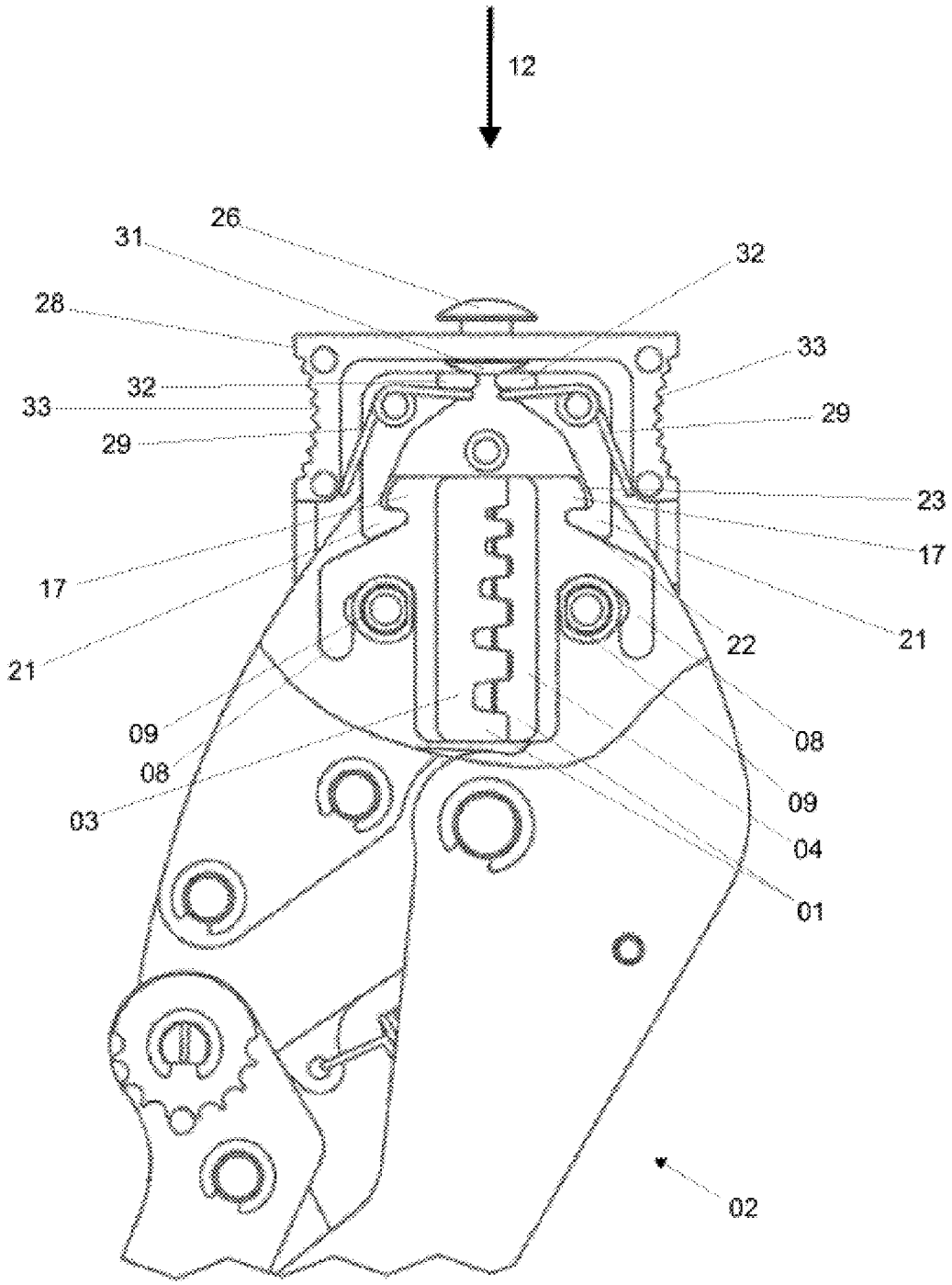
FIG. 5 illustrates the crimping pliers shown in FIG. 1 with the crimping die and an alternative embodiment form of the magazine.

FIG. 5 shows the crimping pliers 02 with crimping die 01 and an alternative embodiment form of the magazine. This embodiment form first is a single magazine 28, with, however, as many of these individual magazines 28 as is desired connected together on their lateral surfaces via connecting rails (not shown), thus forming a magazine for a multiplicity of crimping dies 01, 19. Especially the individual magazine 28, the crimping die 01 and the crimping pliers 02 are shown in the area of crimping die 01 in a cross-sectional depiction. The pivoting hooks 21 are to be pressed toward each other in the individual magazine 28 by two wing pins 29. By pressing the release button 26 in the insertion direction 12, a release stop 31 is pressed against a pivoting hook arm 32 of the two pivoting hooks 21, so that the pivoting hooks 21 pivot away from each other and come out of the hooks 17 of the two die halves 03, 04. By this means, crimping die 01 is again released and can be withdrawn from individual magazine 28. On two sides, individual magazine 28 has a gripping recess 33, so that it can safely be grasped with two fingers.

The invention claimed is:

1. A die for a pliers for pressing of work pieces, the pliers having two jaws, each jaw having a receptacle defined therein, the die comprising a first die half and a second die half, the first and second die halves configured to be inserted jointly or individually into the pliers and removed jointly or individually from the pliers, with each die half including:

a guide for insertion of the die half into a respective receptacle of the jaw of the pliers;

a first connecting element for detachable connection of the die half to the respective receptacle;

and a second connecting element for detachable connection of the die half in an external storage fixture.

2. The die of claim 1, wherein the first connecting element is formed by an open-jaw-like locking element directed in an insertion direction.

3. The die of claim 2, wherein the second connecting elements are formed by hooks which are placed on a side of the respective die half facing away from the insertion direction.

4. The die of claim 3, wherein in a closed state and exclusive of the open-jaw-like locking elements and of the hooks, the die has a cuboid form, with the open-jaw-like locking elements placed on an outer longitudinal side of the cuboid form.

5. The die of claim 4, wherein the open-jaw-like locking elements at a transition to the cuboid form have a rail with ends which form the guide for insertion of the two die halves into the respective receptacles of the pliers, with the hooks embodied as an angled-away extension of one of the ends of the rail.

6. The die of claim 1, wherein both die halves are made as one piece.

7. The die of claim 1, wherein the die has defined within one or more hollow forms for crimping of electrical connection elements.

8. A set of pliers for pressing of work pieces, including the die according to claim 1, wherein the pliers are configured for admitting the die according to claim 1, the pliers including first holding elements that enter into a detachable connection with the first connecting elements of the die halves.

9. The pliers of claim 8, wherein when the pliers are closing, the two die halves move toward each other in a closing direction which is perpendicular to the insertion direction.

10. The pliers of claim 8, wherein the first holding elements are formed by bolts, which are surrounded by the open-jaw-like locking elements of the die halves.

11. The pliers of claim 8, wherein, on a hand grip which is to be regarded as fixed, a first locking surface is shaped, which, when the pliers are in a closed state, lies parallel to and opposite a rear locking surface on a hand grip which is to be regarded as movable, substantially without a gap, and in the opened state, in turn lies parallel to and opposite a forward locking surface of the movable hand grip, substantially without a gap.

12. A storage fixture for storage of multiple dies according to claim 1, wherein the storage fixture includes holding elements which, when inserted into the storage fixture, enter into a detachable connection with the second connecting elements.

13. The storage fixture of claim 12, wherein the holding elements are formed by pivoting hooks, which, in the inserted state, are hooked into corresponding hooks on the two die halves and can be pivoted out by a release element from the hooks.

14. The storage fixture of claim 12, wherein the pivoting hooks are configured to be compressed by a spring toward each other and further include stop surfaces to be directed toward each other, between which a hollow wedge is formed which tapers down in a direction opposite to the insertion direction; with the hooks of the die halves having wedge surfaces directed away from each other, through which a wedge is formed that tapers down in a direction opposite to the insertion direction.

15. The storage fixture of claim 12, wherein the fixture is shaped in the form of a disk-like magazine, into which multiple dies distributed at the edge can be inserted.

16. The storage fixture of claim 12, wherein the fixture is shaped in the form of a single magazine, with the single magazine configured to be detachably connected with one or more additional single magazines.

17. A set of work tools, comprising a set of pliers and multiple dies, which can be used as desired in the pliers, wherein the dies are embodied according to claim 1.

18. The set of work tools of claim 17, further comprising a storage fixture according to claim 12 for receiving one or more dies.

* * * * *